US012539440B2

(12) United States Patent
Parstabar

(10) Patent No.: US 12,539,440 B2
(45) Date of Patent: Feb. 3, 2026

(54) STRENGTH AND MOBILITY EXERCISE APPARATUS

(71) Applicant: Amir Parstabar, Beverly Hills, CA (US)

(72) Inventor: Amir Parstabar, Beverly Hills, CA (US)

( * ) Notice: Subject to any disclaimer, the term of this patent is extended or adjusted under 35 U.S.C. 154(b) by 292 days.

(21) Appl. No.: 18/375,501

(22) Filed: Sep. 30, 2023

(65) Prior Publication Data

US 2024/0108936 A1 Apr. 4, 2024

Related U.S. Application Data

(60) Provisional application No. 63/411,938, filed on Sep. 30, 2022.

(51) Int. Cl.
*A63B 21/075* (2006.01)
*A63B 21/072* (2006.01)

(52) U.S. Cl.
CPC ..... *A63B 21/075* (2013.01); *A63B 21/0728* (2013.01)

(58) Field of Classification Search
CPC .. A63B 21/072; A63B 21/0728; A63B 21/075
See application file for complete search history.

(56) References Cited

U.S. PATENT DOCUMENTS 257,929 A * 5/1882 Folk ..... A63B 15/00 482/109
275,627 A * 4/1883 Foster et al. ..... A63B 15/00 473/118
295,429 A * 3/1884 Reach ..... A63B 15/00 473/118
596,543 A * 1/1898 Randall ..... A63B 15/00 473/118
675,314 A * 5/1901 Abenheim ..... A63B 21/075 482/109
5,741,193 A * 4/1998 Nolan ..... A63B 60/16 473/519
6,682,447 B1 * 1/2004 Black ..... A63B 15/00 473/519
7,179,210 B2 * 2/2007 Soukeras ..... A63B 21/0605 473/118
7,563,208 B1 * 7/2009 Chen ..... A63B 21/075 482/93

(Continued)

*Primary Examiner* — Joshua Lee
(74) *Attorney, Agent, or Firm* — Fitzsimmons IP Law

(57) ABSTRACT

A system and method is provided for improving strength via an exercise apparatus. In one embodiment of the present invention, the apparatus comprises a body having a proximal end and a distal end, with a handle being located at the proximal end, and a plurality of vertically arranged slots descending from the handle toward to the distal end of the body. The apparatus further comprises a plurality of (removable) weight rings configured to be placed into the plurality of slots, thereby adding weight to the apparatus. Each weight ring may further include a pin configured to mate with a corresponding slot on the body, thereby affixing the weight ring to the body during use. Unlike traditional dumbbells, which are symmetrical (i.e., equal amounts of weight are positioned on opposite sides of the grip), the present invention is asymmetrical, where weights are only located on one side of the grip.

17 Claims, 9 Drawing Sheets

(56) References Cited

U.S. PATENT DOCUMENTS

| | | | | |
|---|---|---|---|---|
| 7,731,640 | B1 * | 6/2010 | Chen | A63B 21/0728 482/93 |
| 7,811,212 | B2 * | 10/2010 | Chen | A63B 21/072 482/106 |
| 8,951,172 | B2 * | 2/2015 | Marcus | A63B 15/00 482/109 |
| 10,166,428 | B2 * | 1/2019 | Giafardino | A63B 21/072 |
| 10,166,429 | B2 * | 1/2019 | Chen | A63B 21/0728 |
| 10,420,978 | B2 * | 9/2019 | Wang | A63B 21/072 |
| 11,027,182 | B2 * | 6/2021 | Mainini | A63B 21/072 |
| 11,185,749 | B2 * | 11/2021 | Wiese | A63B 59/56 |
| 11,541,295 | B2 * | 1/2023 | Snyder | A63B 69/3632 |
| 11,964,194 | B2 * | 4/2024 | Dev | A63B 69/0002 |
| 2004/0063520 | A1 * | 4/2004 | Mabry | A63B 69/0002 473/457 |
| 2008/0202317 | A1 * | 8/2008 | Capotosto | A63B 21/0004 84/422.4 |
| 2017/0095687 | A1 * | 4/2017 | Sonnon | A63B 21/0728 |
| 2021/0154551 | A1 * | 5/2021 | Christiansen | A63B 15/00 |

* cited by examiner

STRENGTH AND MOBILITY EXERCISE APPARATUS

BACKGROUND OF THE INVENTION

1. Field of the Invention

The present invention relates to an exercise apparatus, or more particularly, to an apparatus that is easy to use (e.g., easy to adjust), easy to transport, and well suited for exercises that increase strength and mobility, isolate and train specific muscles, and provide a whole-body workout.

2. Description of Related Art

There are many different types of exercise equipment, ranging from large machines (e.g., treadmills, squat racks, weight-stacked machines (e.g., Nautilus™, etc.), etc.) to small, handheld devices (e.g., jump ropes, dumbbells, hand squeezers, etc.). And for each one of these devices, there are many different styles to choose from. For example, the dumbbell is a popular type of free weight (i.e., an object that is "free," or not attached to anything, and can be picked up and moved for strength training). While there are many types of dumbbells, they can generally be broken down into two groups—fixed and adjustable.

Fixed dumbbells are weights created in a dumbbell shape, generally constructed from cast iron; sometimes coated with rubber or neoprene for comfort. The problem with fixed dumbbells is that their weight is "fixed," and in order to increase or decrease the weight that is being lifted, different dumbbells are needed. This is why fixed dumbbells are generally sold in sets (e.g., ranging from one to seven pounds for light lifting, etc.). This is a good solution for gyms, but not a good solution for an individual who may be taking their weights with them (e.g., to a yoga studio, on vacation, etc.).

There are generally two different types of adjustable dumbbells—plate-loaded dumbbells and "selectorized" dumbbells. With plate-loaded, different free weights are slid onto a metal bar (e.g., engraved with a crosshatch pattern to improve grip) and secured with clips or collars. Similar to fixed dumbbells, these are not a good solution for individuals as a plurality of free weights are required. "Selectorized" dumbbells are adjustable dumbbells whose number of plates (i.e., weight) can be easily changed when resting in the dumbbell stand. This is achieved by adjusting the number of plates that follow the handle when lifted, e.g., by turning a dial or moving a selector pin—rather than manually adding or removing plates.

While "selectorized" dumbbells are better for home use, they are not well suited for travel as they require a stand that doubles as storage for the additional weights not being used for a particular exercise. Moreover, the mechanism for increasing and decreasing weight can be quite cumbersome and complex, thereby increasing the size and weight of the overall system (e.g., stand, weights, handle, switching mechanism, etc.).

In light of the foregoing, there is a need to develop an alternative to the adjustable dumbbell that is both easy to use (e.g., easy to adjust) and transportable (e.g., easy to take to the yoga studio, on vacation, etc.). The alternative should also be well suited for exercises that increase strength and mobility, isolate and train specific muscles, and provide a whole-body workout. As such, the inventor has designed and developed a new and improved exercise apparatus that achieves the foregoing, while addressing many drawbacks that exist with traditional, adjustable dumbbells.

SUMMARY OF THE INVENTION

The present invention provides a system and method for improving strength and mobility via an exercise apparatus. Preferred embodiments of the present invention comprise a body having a proximal end and a distal end, with a handle being located at the proximal end of the body and a plurality of vertically arranged slots descending from the handle toward the distal end of the body. Preferred embodiments further comprise a plurality of weights configured to be placed into the plurality of slots, thereby adding weight to the apparatus.

In a first embodiment of the present invention, the apparatus comprises a main body and a plurality of weight rings, where each weight ring is removable. In one embodiment, the main body has the shape of a bowling pin, where the (removable) weight rings are at one end (e.g., the distal end) and the handle (for gripping by the user) is at the other end (e.g., the proximal end).

The main body and each weight ring should be constructed to have specific weights. For example, the main body and each individual weight ring may have a weight of one pound. That way, if the main body is being used without any additional weight, the weight of the apparatus would be one pound. However, the apparatus can be made heavier (in one-pound increments) by adding individual weight rings. For example, adding one weight ring results in an apparatus weighing two pounds, adding two weight rings results in an apparatus weight three pounds, and so forth.

It should be appreciated that because the diameter of each weight ring increases as you go from a proximal end top main body to the distal end, the weight rings may decrease in thickness in order to maintain a uniform weight. For example, the second weight ring from the handle may have a larger diameter and be thinner than the first weight ring, the third weight ring from the handle may have a larger diameter and be thinner than the second weight ring, etc. In an alternate embodiment, each weight ring may also (or alternatively) have different diameters but still have the same weight by using different and/or less material.

In one embodiment, the system that further includes a carrying case that is configured to receive and store the apparatus. As such, the carrying case preferably includes a larger opening on the bottom (sized to snuggly fit the distal end of the apparatus) and a smaller opening on the top (sized to snuggly fit the proximal end of the apparatus). The carrying case is preferably constructed from a dense foam material, with an interior that is substantially "bowling pin" shaped. However, other materials and designs are within the spirit and scope of the present invention.

The main body is preferably constructed from black plastic, with rubber (e.g., astronaut grade rubber with a series of grooves) on the handle for optimal gripping, and the weight rings are preferably constructed from stainless steel. However, other materials are within the spirit and scope of the present invention, as long as each item's weight is within a certain tolerance of the design constraints (e.g., weights accorded to each component).

It should also be appreciated that each component may be constructed using more than one material. For example, in order to secure each weight ring on the main body, the main body may include a metal shaft having a locking slot, and each weight ring may include a pin (the pin may be constructed from the same material as the weight ring or a different material). The purpose of the pin and the locking slot is to secure (or "lock") each weight ring to the main body during use, and to allow for its removal if a different overall weight is desired. In one embodiment, the pin includes a head and a shaft, where the head has a larger diameter than the shaft. Similarly, the locking slot on the metal shaft has two different sized openings—a larger (circular) opening that is slightly larger than the head and smaller (elongated) opening that is slightly larger than the shaft, but smaller than the head. This allows the weight ring to be secured to the main body by inserting the head into the larger opening of the locking slot and rotating the weight ring with respect to the main body, thereby moving the shaft (and the head behind) along the smaller opening of the locking slot. This rotational movement of the weight ring with respect to the main body results in securing the weight ring to the main body so that the apparatus is ready for use.

The foregoing apparatus (e.g., an all-in-one Indian club) is both easy to use and to take anywhere (i.e., transportable). It can be used to increase strength, mobility, and endurance, isolate and train specific muscles, and engages the user's core, thereby providing a whole-body workout. Unlike traditional dumbbells, which are symmetrical (i.e., equal amounts of weight are positioned on opposite sides of the grip), the present invention is asymmetrical, where weights are only located on one side of the grip. This unique configuration allows the user to exercise differently, utilizing different muscle groups, with countless easy-to-learn workouts.

In one embodiment, the apparatus mimics a human spine, where the main body incorporates the weighted vertebrae discs to add or deduct weight for desired exercises' impact. Each vertebrae plate is inserted into the cavity where the steel ballpoint is locked into a cavity and locked in place by rotating the plate into the lock mode. The grip section of the apparatus is preferably ribbed to prevent sliding while the extended end guard secures the grip.

A more complete understanding of a system and method for improving strength and mobility via an exercise apparatus will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

Figure 1:
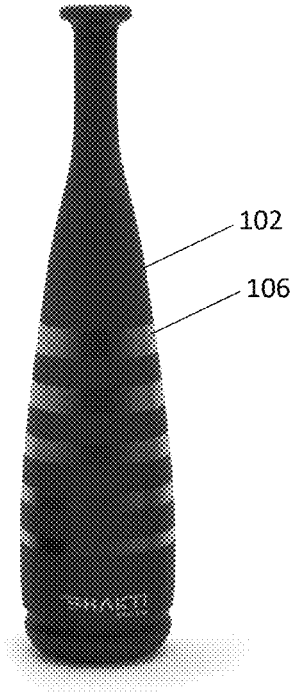
FIG. 1 illustrates an exercise apparatus in accordance with one embodiment of the present invention, comprising a main body and a plurality of removable weight rings.
Figure 2:
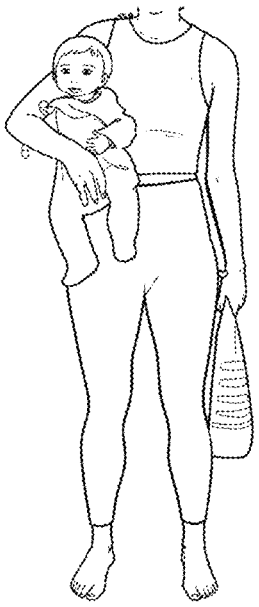
FIG. 2 illustrates how the exercise apparatus depicted in FIG. 1 can be held by a user.

The present invention provides a system and method for improving strength and mobility via an exercise apparatus. With reference to FIG. 1, the apparatus comprises a main body 102 and a plurality of weight rings 106, where each weight ring 106 is removable. As can be seen, the main body 102 has the shape of a bowling pin, where the (removable) weight rings 106 are at one end (e.g., the distal end) and the handle (for gripping by the user) is at the other end (e.g., the proximal end). A user holding the apparatus can be seen in FIG. 2. While such a design is more advantageous for certain exercises (e.g., yoga, aerobics, Capoeira, etc.) and provides more of a "whole-body workout" (as opposed to a traditional dumbbell), it should be appreciated that other shapes (e.g., ones that do not resemble a bowling pin) are within the spirit and scope of the present invention.

Figure 3A:
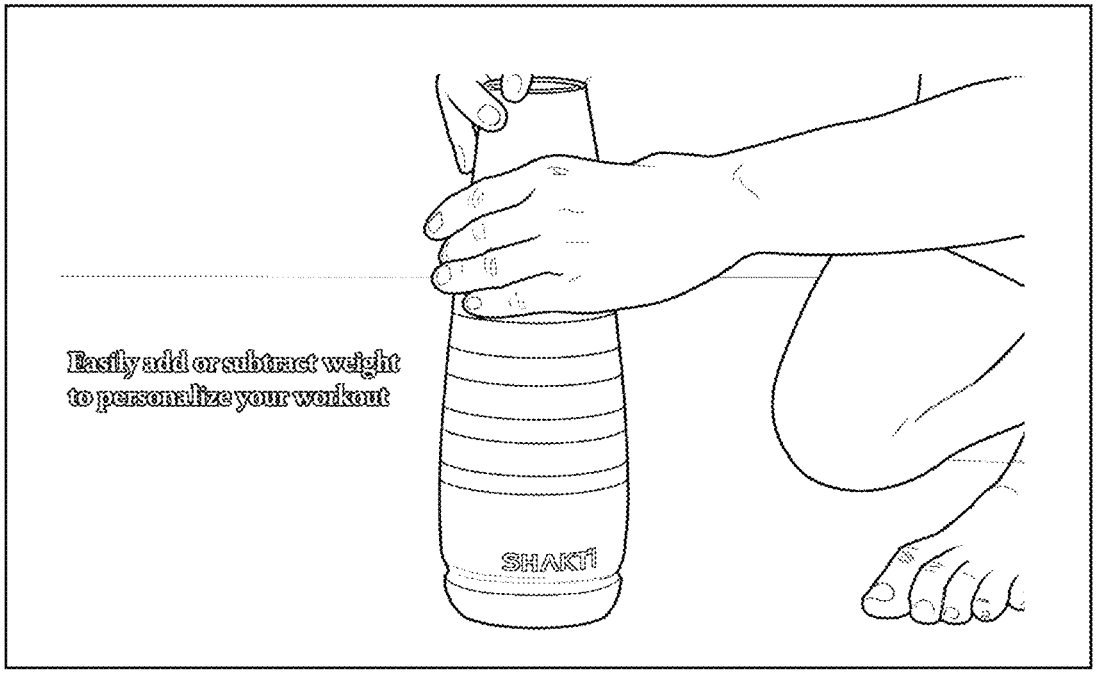
FIGS. 3A-G illustrate the exercise apparatus depicted in FIG. 1 with various weight rings removed.
Figure 3B:
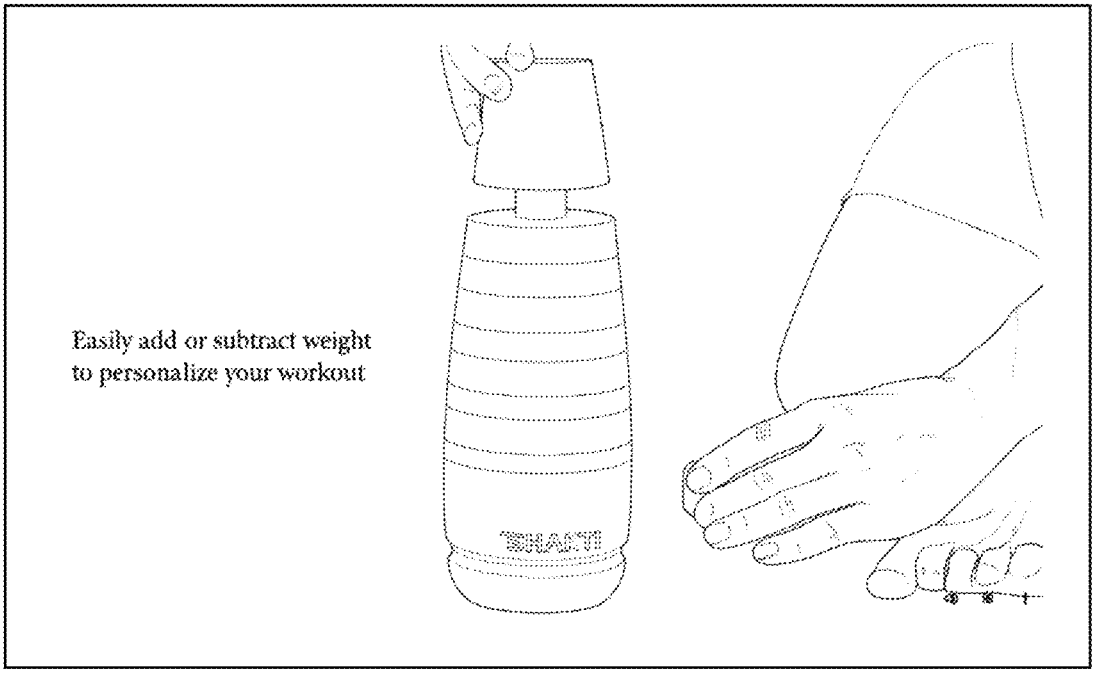
Figure 3C:
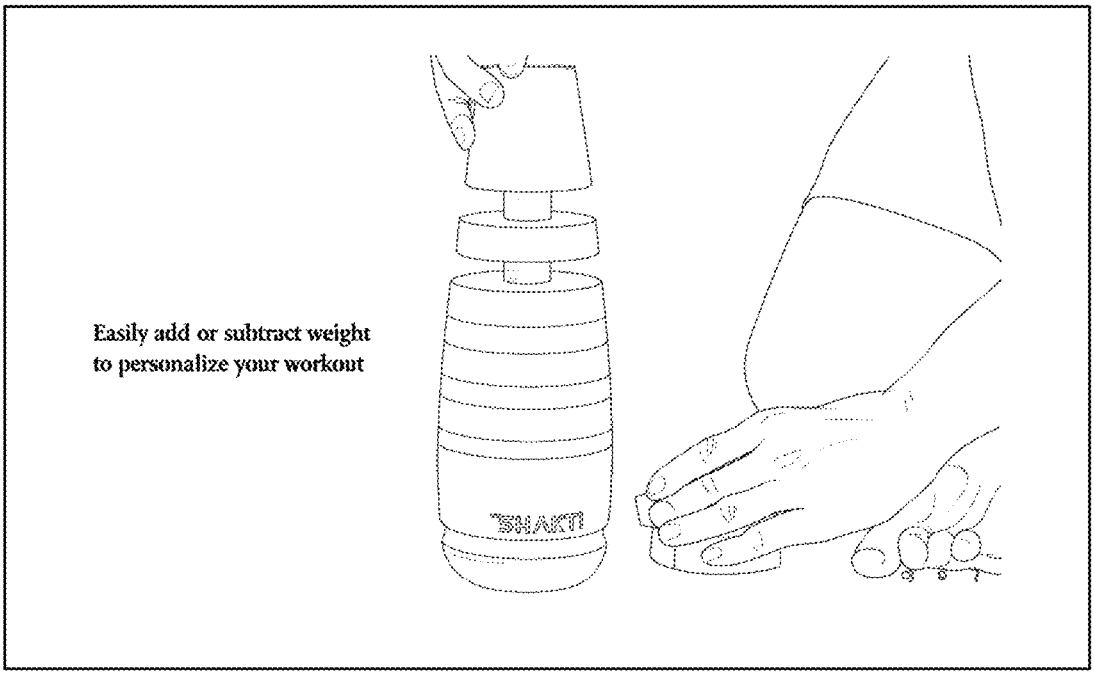
Figure 3D:
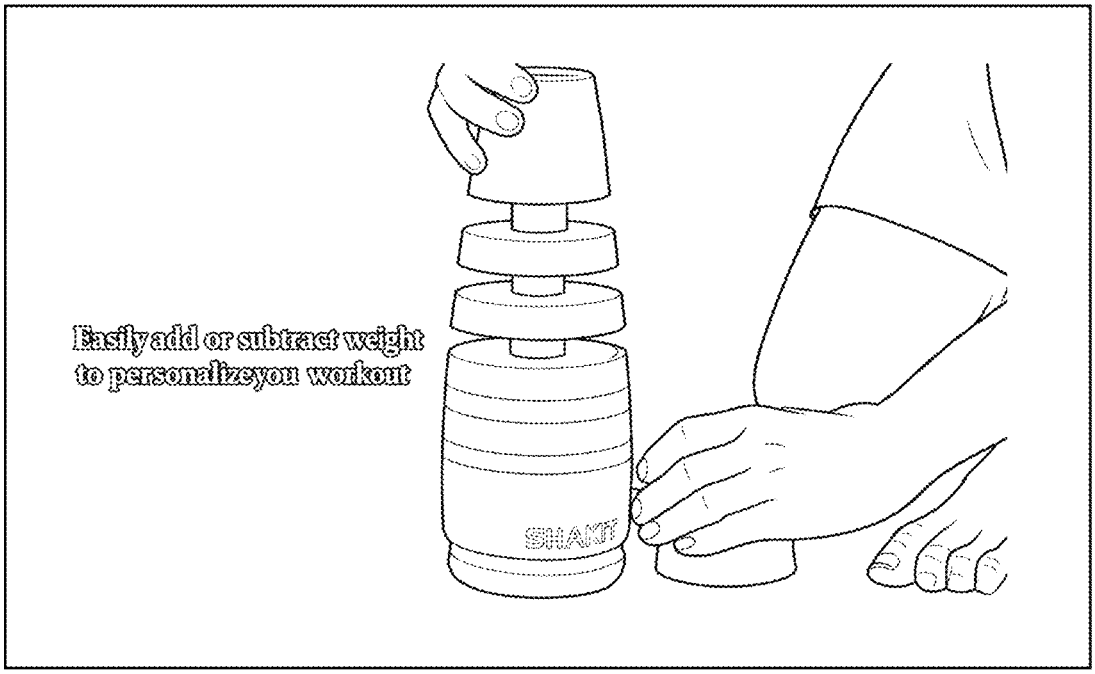
Figure 3E:
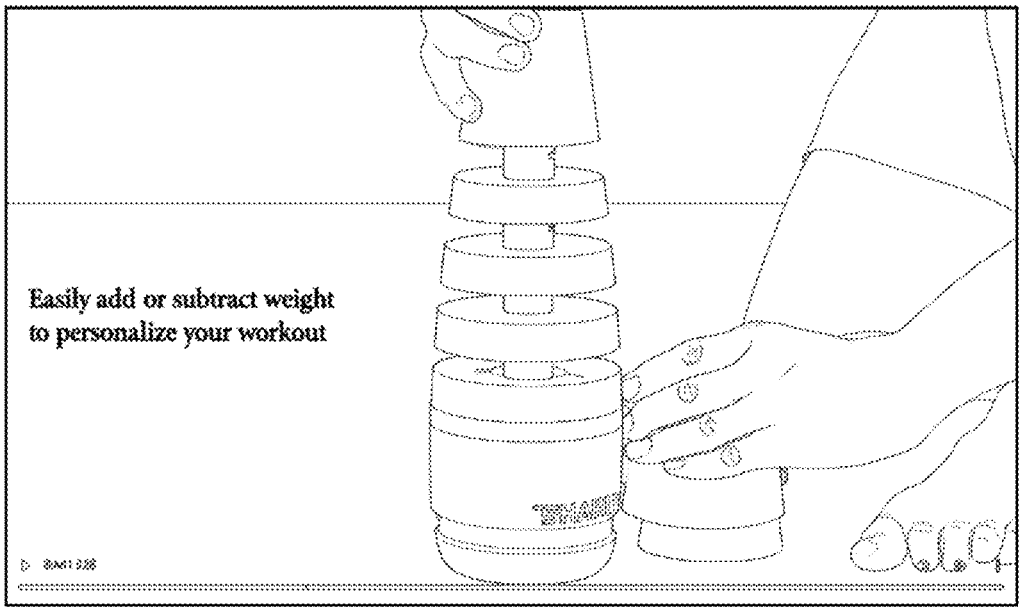
Figure 3F:
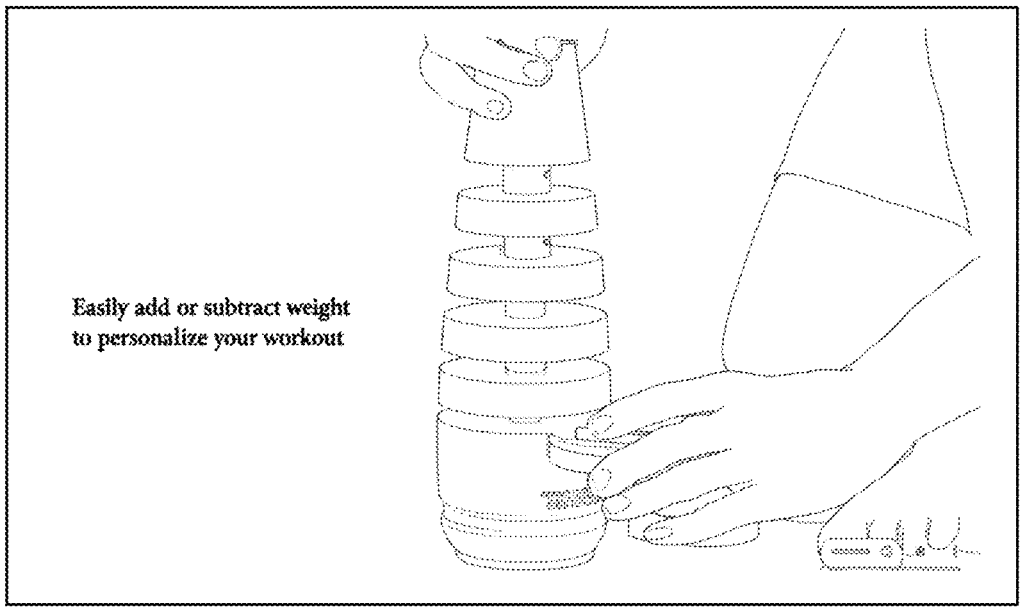
Figure 3G:
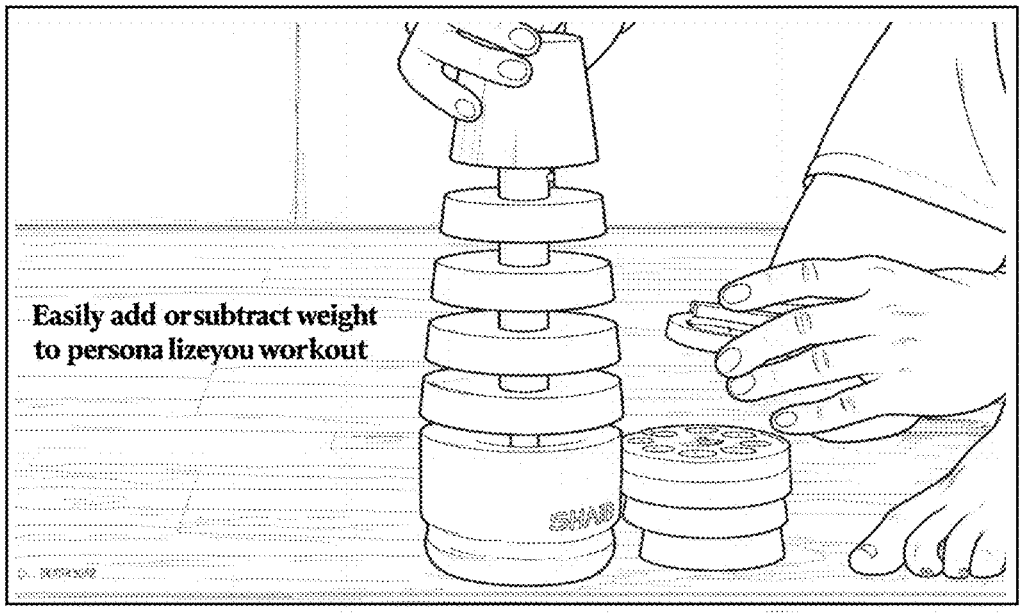
Figure 6A:
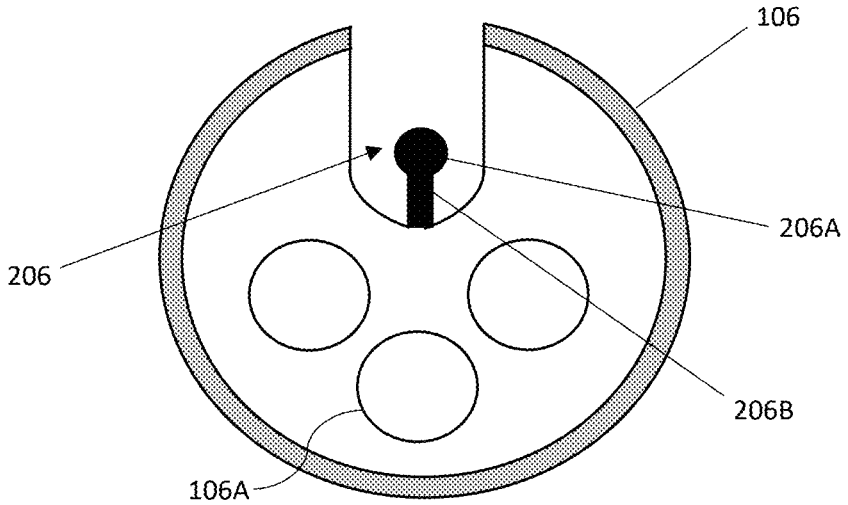

As discussed above, the weight rings 106 can preferably be removed from the main body 102. This can be seen in FIGS. 3A-G, where individual weight rings 106 are removed. The main body 102 and each weight ring 106 should be constructed to have specific weights. For example, the main body 102 and each individual weight ring 106 may have a weight of one pound. That way, if the main body 102 is being used without any additional weight (see, e.g., FIG. 3G), the weight of the apparatus would be one pound. However, the apparatus can be made heavier (in one-pound increments) by adding individual weight rings 106. For example, adding one weight ring (FIG. 3E) results in an apparatus weighing two pounds, adding two weight rings (FIG. 3D) results in an apparatus weight three pounds, and so forth. Using this example, a fully loaded apparatus would weigh seven pounds (i.e., a one-pound main body plus six, one pound weight rings). It should be appreciated that because the diameter of each weight ring increase as you go from a top of the apparatus (where the apparatus is held by the user) to a bottom (away from the user), the weight rings may decrease in thickness in order to maintain a uniform weight. For example, the second weight ring from the handle may have a larger diameter and be thinner than the first weight ring, the third weight ring from the handle may have a larger diameter and be thinner than the second weight ring, etc. In an alternate embodiment, each weight ring may also (or alternatively) have different diameters but still have the same weight by using different and/or less material. For example, as shown in FIG. 6A, at least one aperture 106A may be provided to reduce the weight of an individual ring.

It should be appreciated that the present invention is not limited to the foregoing one-pound example (where each component weighs one pound). For example, a main body that weighs five pounds, with each weight ring weighing one pound is within the spirit and scope of the present invention. Similarly, a main body that weighs five pounds, with a first weight ring weighing four pounds, a second weight ring weighing three pounds, a third weight ring weighing two pounds, etc., is also within the spirit and scope of the present invention. By varying the weight of each weight ring, additional combinations are possible. Different combinations are also possible by providing more than one weight ring having the same dimensions (e.g., same diameter, same thickness, etc.) where each ring has a different weight (e.g., by varying its material, varying its mass (e.g., one without apertures, one with at least one aperture, one with more apertures, etc.), etc.).

Figure 4:
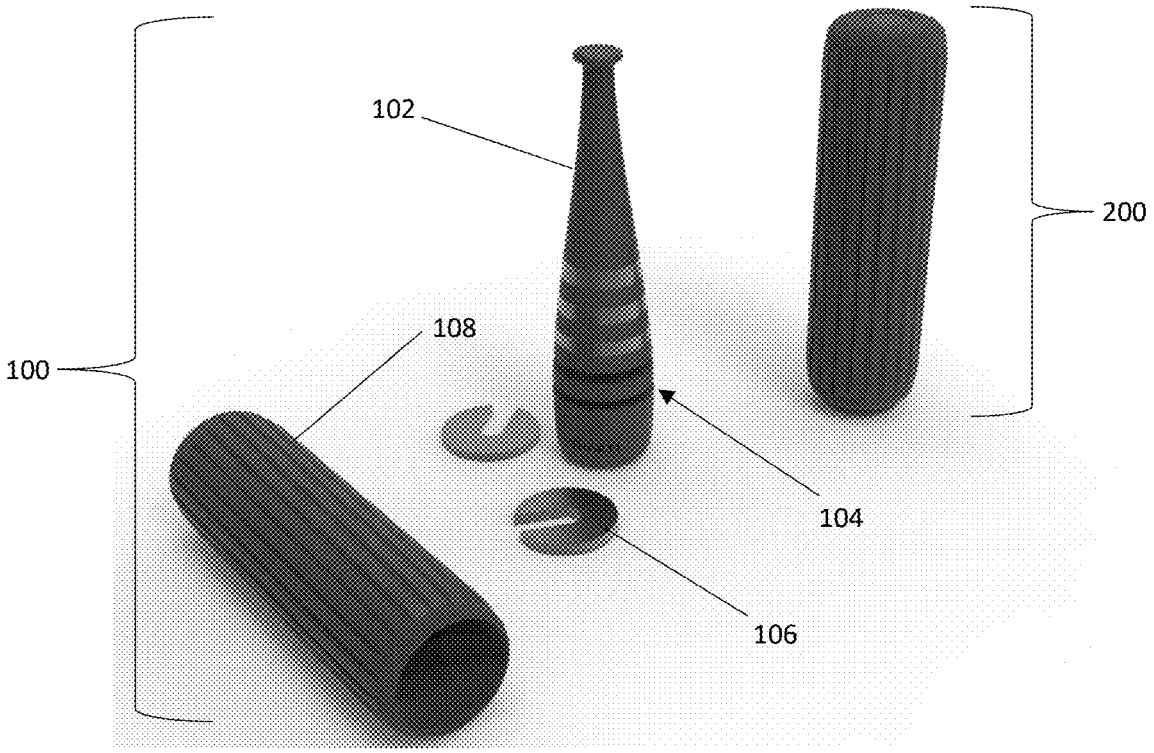
FIG. 4 illustrates the exercise apparatus depicted in FIG. 1 together with carrying case.

FIG. 4 shows a system that further includes a carrying case 108 (FIG. 4 shows both the apparatus outside of the carrying case (100) (e.g., deconstructed) and the apparatus inside the carrying case (200) (e.g., assembled)). In a preferred embodiment, the carrying case 108 is configured to receive and store the apparatus. As such, it preferably has a larger opening on the bottom (sized to snuggly fit the distal end of the apparatus) and a smaller opening on the top (sized to snuggly fit the proximal end of the apparatus). As before, the apparatus comprises a main body 102 having a plurality of slots 104, where each slot 104 is configured to receive a corresponding weight ring 106. The carrying case 108 is preferably constructed from a dense foam material, with an interior that is substantially "bowling pin" shaped. However, other materials and designs are within the spirit and scope of the present invention.

Figure 8:
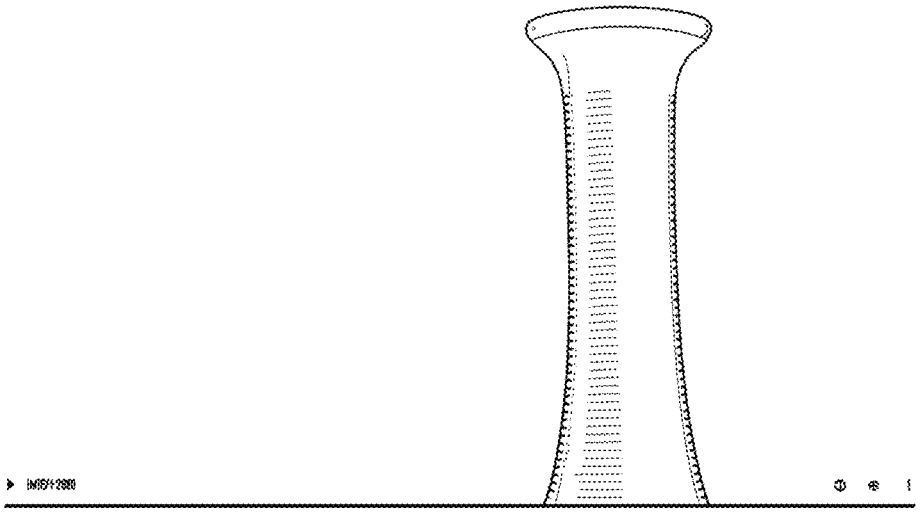
FIG. 8 illustrates a ribbed handle portion of the exercise apparatus in accordance with one embodiment of the present invention.

The main body 102 is preferably constructed from black plastic, with rubber (e.g., astronaut grade rubber with a series of grooves) on the handle for optimal gripping (see FIG. 8), and the weight rings 106 are preferably constructed from stainless steel. However, other materials are within the spirit and scope of the present invention, as long as each item's weight is within a certain tolerance of the design constraints (e.g., weights accorded to each component).

It should also be appreciated that each component may be constructed using more than one material. For example, in order to secure each weight ring on the main body, the main body may include a metal shaft 110 having a locking slot 210, and each weight ring 106 may include a pin 206 (the pin may be constructed from the same material as the weight ring or a different material). The purpose of the pin 206 and the locking slot 210 is to secure (or "lock") each weight ring 106 to the main body 102 during use, and to allow for its removal if a different overall weight is desired.

Figure 5:
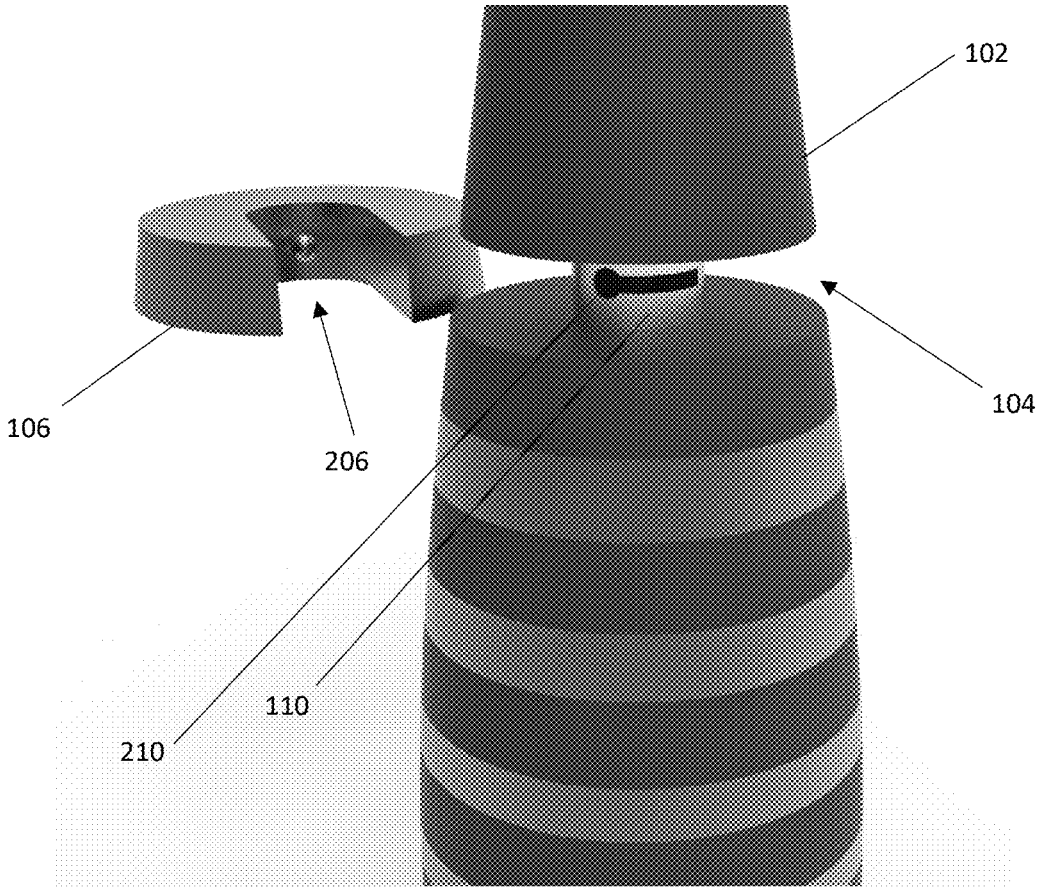
FIGS. 5, 6A and 7 illustrate one way in which the weight ring can be attached to and detached from the main body.

As can be seen in FIGS. 5 and 6A (FIG. 6A showing a cross-sectional upper view of an individual weight ring), the pin 206 preferably has a head 206A and a shaft 206B, where the head 206A has a larger diameter than the shaft 206B. Similarly, the locking slot 210 on the metal shaft 110 has two different sized openings—a larger (circular) opening that is slightly larger than the head 206A and smaller (elongated) opening that is slightly larger than the shaft 206B, but smaller than the head 206A. This allows the weight ring 106 to be secured to the main body by inserting the head 206A into the larger opening of the locking slot 210 and rotating the weight ring 106 with respect to the main body 102, thereby moving the shaft 206B (and the head 206A behind) along the smaller opening of the locking slot 210. This rotational movement of the weight ring 106 with respect to the main body 102 results in securing the weight ring 106 to the main body 102 so that the apparatus is ready for use. The foregoing features can also be seen in FIG. 7.

Figure 6B:
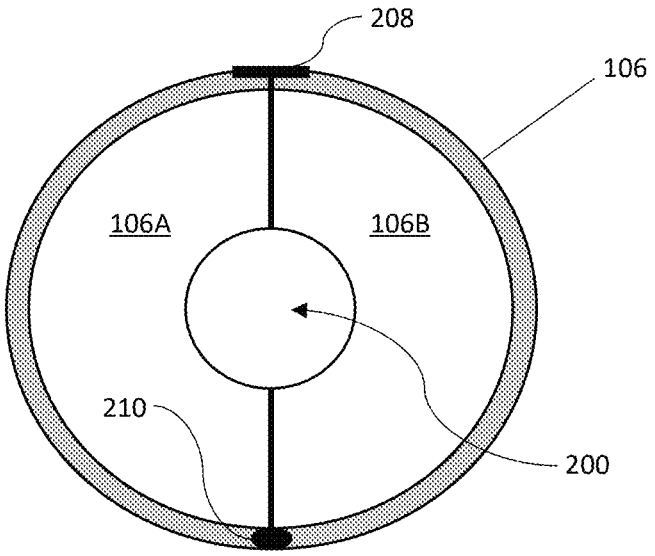
FIGS. 6B and C illustrate alternate ways in which the weight ring can be attached to and detached from the main body.
Figure 6C:
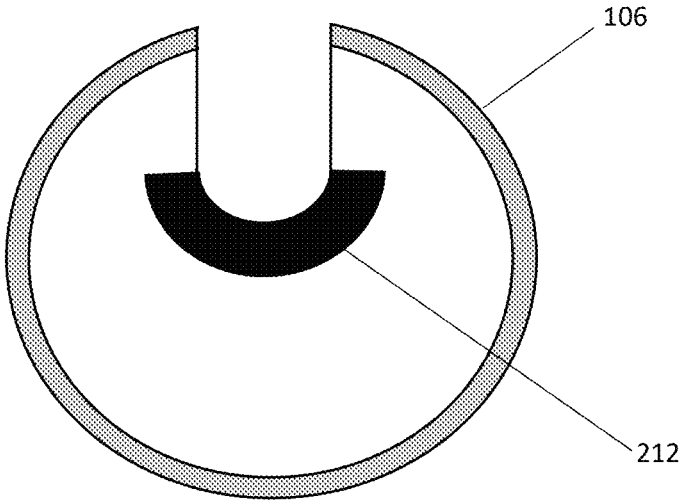

It should be appreciated that other locking mechanisms are within the spirit and scope of the present invention. For example, as shown in FIG. 6B, the ring 106 could comprise two halves (106A, 106B) connected to each other via a hinge 210 and a clasp 208, thereby allowing the ring to be opened (not shown) and closed (as shown in FIG. 6B). In the closed position, the ring would include an aperture 200 having a diameter slightly larger than that of the metal shaft 110. By way of another example, as shown in FIG. 6C, the ring 106 could include a magnet 212 having a pull force that will both hold the ring against the metal shaft 110 while working out and allowing the user to remove the ring if desired (e.g., 1-5 lb. pull force) (design dependent).

It should also be appreciated that the locking slot 210 and the pin 206 may be constructed in such a way that friction (e.g., between the shaft and/or the head and the smaller opening, which may increase as the weigh ring is rotated) helps secure the weight ring 106 to the main body 102. It should further be appreciated, that in the preferred embodiment, because the slot in the weight ring 106, once the ring is attached to the main body 102, the front of the apparatus looks solid, whereas the back of the apparatus includes a plurality of recesses that are preferably vertically aligned.

As discussed above, the apparatus (e.g., an all-in-one Indian club) is both easy to use and to take anywhere (i.e., transportable). It can be used to increase strength, mobility, and endurance, isolate and train specific muscles, and engages the user's core, thereby providing a whole-body workout. Unlike traditional dumbbells, which are symmetrical (i.e., equal amounts of weight are positioned on opposite sides of the grip), the present invention is asymmetrical, where weights are only located on one side of the grip. This unique configuration allows the user to exercise differently, utilizing different muscle groups. As can be seen, the apparatus is not only fun to use, but can be used with countless easy-to-learn workouts.

Figure 7:
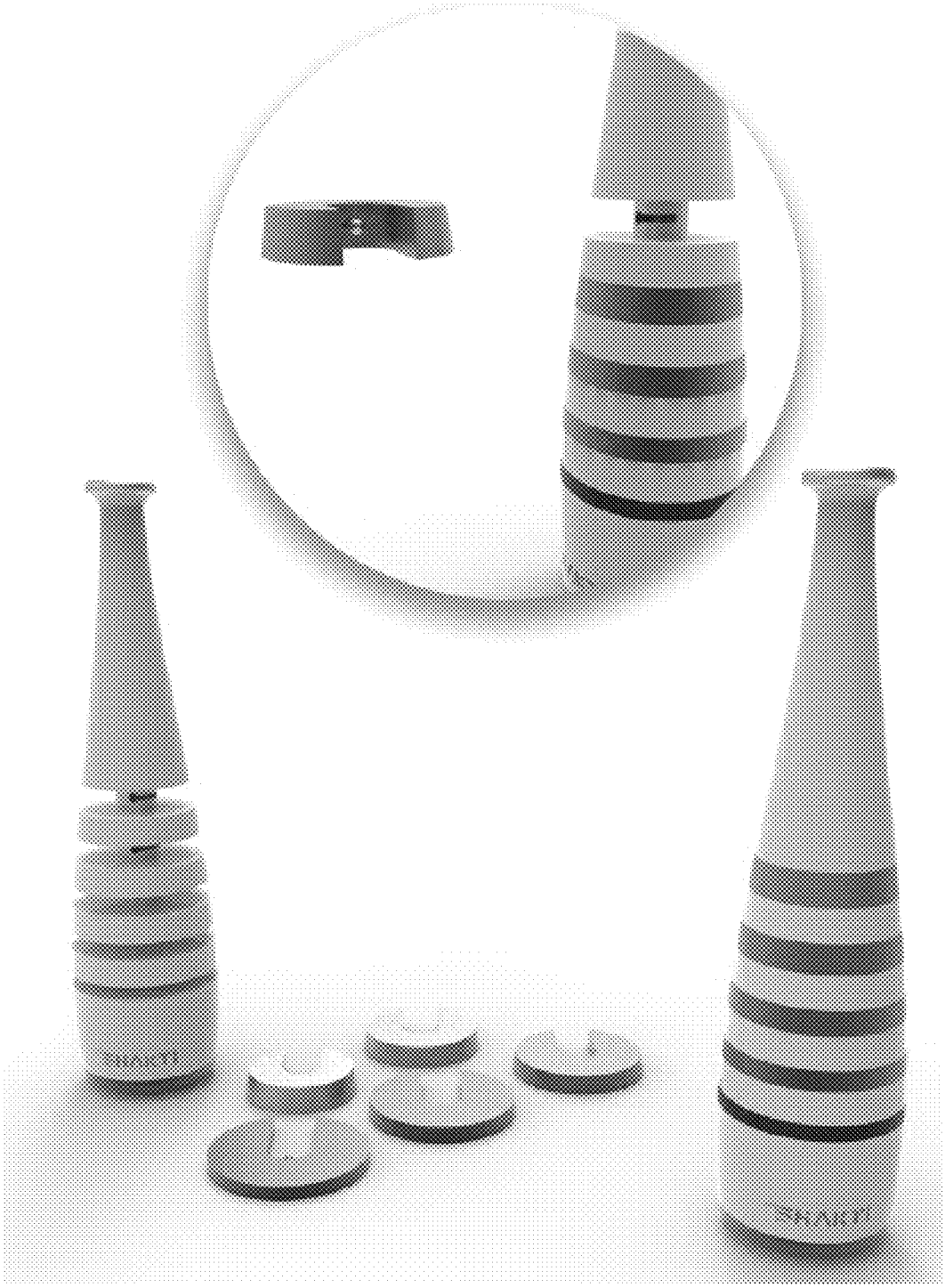

As can be seen in FIG. 7, the apparatus mimicking a human spine, where the main body incorporates the weighted vertebrae discs to add or deduct weight for desired exercises' impact. Each vertebrae plate is inserted into the cavity where the steel ballpoint is locked into a cavity and locked in place by rotating the plate into the lock mode. The grip section of the apparatus is preferably ribbed to prevent sliding while the extended end guard secures the grip. The embodiment discussed herein adds up to six pounds with the main body (the "club") itself representing one pound. The concept can be expanded to other versions with varying weight combinations.

The foregoing description of an exercise apparatus has been presented for the purposes of illustration and description. It is not intended to be exhaustive or to limit the invention to the precise forms disclosed, and many modifications and variations are possible in light of the above teachings. Those skilled in the art will appreciate that there are a number of ways to implement the foregoing features, and that the present invention it not limited to any particular way of implementing these features. The invention is solely defined by the following claims.

What is claimed is:

1. An exercise apparatus comprising:

a body having a proximate end and a distal end, said body comprising a handle at said proximate end configured to be gripped by a user's hand and a plurality of slots arranged vertically along said body between a distal end of said handle and said distal end of said body;

a plurality of weights, each one of said plurality of weights being configured to be slid into a corresponding one of said plurality of slots on said body, thereby adding weight to said exercise apparatus; and a means for affixing said each one of said plurality of weights to said body, wherein each one of said plurality of weights has a notch on one side, said notch being configured to mate with said center shaft of said body, and wherein said notch includes a pin configured to mate with a slot in a center shaft of said body, thereby affixing a corresponding one of said plurality of weights to said body.

2. The exercise apparatus of claim 1, wherein said body comprises a center shaft connecting said proximal end of said body to said distal end of said body.

3. The exercise apparatus of claim 1, wherein each one of said plurality of weights is substantially circular having a diameter that increases from said proximal end of said body to said distal end of said body.

4. The exercise apparatus of claim 3, wherein each one of said plurality of weights has a diameter that is substantially equal to a diameter of said corresponding one of said plurality of slots.

5. The exercise apparatus of claim 3, wherein each one of said plurality of weights has a thickness that decreases from said proximal end of said body to said distal end of said body.

6. The exercise apparatus of claim 1, wherein said notch is U-shaped.

7. The exercise apparatus of claim 1, wherein said pin further comprises a head and a shaft and said slot further comprising a larger circular opening configured to receive said head of said pin and a smaller elongated opening configured to receive with said shaft of said pin, wherein said head has a larger diameter than said shaft.

8. The exercise apparatus of claim 7, wherein said corresponding one of said plurality of weights is affixed to said body by rotating said corresponding one of said plurality of weights with respect to said body after said head of said pin has been placed through said larger circular opening, thereby sliding said shaft of said pin from said larger circular opening into said smaller elongated opening.

9. A method for using an exercise apparatus, comprising:

gripping a handle portion of a body, said handle being at a proximate end of said body and said body comprising a plurality of slots arranged vertically along said body between a distal end of said handle and a distal end of said body;

placing individual ones of a plurality of weights into corresponding ones of said plurality of slots on said body, thereby adding weight to said exercise apparatus; and rotating said individual ones of said plurality of weights with respect to said body, thereby affixing said individual ones of said plurality of weights to said body, wherein each one of said plurality of weights comprises a pin configured to mate with a corresponding slot on said body.

10. The method of claim 9, wherein each one of said plurality of weights includes a U-shaped notch and said step of placing individual ones of a plurality of weights into corresponding ones of said plurality of slots further comprises placing said notch around a center shaft of said body.

11. The method of claim 9, wherein each one of said plurality of weights is substantially circular.

12. The method of claim 11, wherein each one of said plurality of weights has a diameter that increases from said proximal end of said body to said distal end of said body.

13. The method of claim 11, wherein each one of said plurality of weights has a thickness that decreases from said proximal end of said body to said distal end of said body.

14. The method of claim 9, wherein said step of placing individual ones of a plurality of weights into corresponding ones of said plurality of slots on said body further comprises placing said pin into said corresponding slot on said body.

15. The method of claim 14, wherein said pin further comprises a head and a shaft and said slot further comprising a larger circular opening configured to receive said head of said pin and a smaller elongated opening configured to receive said shaft of said pin, wherein said head of said pin has a diameter that is larger than said shaft of said pin.

16. The method of claim 15, wherein said step of rotating said individual ones of said plurality of weights with respect to said body further comprises sliding said pin from said larger circular opening into said smaller elongated opening.

17. An exercise apparatus comprising:

a body having a proximate end, a distal end, a handle located at said proximate end, and a plurality of slots arranged vertically along said body between a distal end of said handle and said distal end of said body;

a first one of said plurality of weights configured to be slid into a first one of said plurality of slots, adjacent said handle; and a second one of said plurality of weights configured to be slid into a second one of said plurality of slots, adjacent said first one of said plurality of slots, wherein said first one of said plurality of weights is affixed to said body by placing a pin portion of said weight into a slot portion of said body and rotating said first one of said plurality of weights with respect to said body, thereby sliding said pin portion from a larger opening in said slot portion to a smaller opening in said slot portion.

* * * * *